United States Patent [19]

Wageley

[11] 4,332,266

[45] Jun. 1, 1982

[54] PORTABLE BLIND AND SHELTER

[76] Inventor: Tevis R. Wageley, R.F.D. No. 4, Box 428, Martinsburg, W. Va. 25401

[21] Appl. No.: 180,460

[22] Filed: Aug. 22, 1980

[51] Int. Cl.[3] ..... E04F 10/02

[52] U.S. Cl. ..... 135/5 R; 135/4 B; 135/DIG. 1

[58] Field of Search ..... 135/4, 5 R, 7.1, DIG. 1; 160/133, 134

[56] References Cited

U.S. PATENT DOCUMENTS

| | | | |
|---|---|---|---|
| 90,054 | 5/1869 | Searle | 135/8 |
| 295,013 | 3/1884 | Hunter | 160/134 X |
| 1,618,065 | 2/1927 | Davis | 135/5 R |
| 2,266,853 | 12/1941 | Dabney | 135/DIG. 1 |
| 2,543,597 | 2/1951 | Peery | 135/7.1 R |
| 2,910,078 | 10/1959 | Schunck | 135/7.1 R |
| 3,121,439 | 2/1964 | Moltchan | 135/7.1 R |
| 3,134,426 | 5/1964 | Cherubin | 160/133 X |
| 3,190,300 | 6/1965 | Wear'n | 135/5 |
| 3,285,260 | 11/1966 | Rowe | 135/7.1 R |
| 3,394,720 | 7/1968 | Moss | 135/5 R |
| 3,404,696 | 10/1968 | Filho | 135/5 R |
| 4,098,281 | 7/1978 | Bonfilio | 135/5 R |

FOREIGN PATENT DOCUMENTS

| | | | |
|---|---|---|---|
| 77721 | 7/1933 | Sweden | 135/DIG. 1 |

*Primary Examiner*—J. Karl Bell
*Attorney, Agent, or Firm*—Frank L. Abbott

[57] ABSTRACT

A light weight, portable, folding blind for use by hunters, photographers, bird watchers and others who desire their position to be obscured or concealed. The blind is comprised of a central support mast to which a flexible substantially semi-circular material is attached along a central radius. The central mast has a ground penetrating element which is stuck in the ground to support the blind. There are additional ribs whereby the flexible material fans out to conceal the user. A hood for protection from the elements may also be used if desired.

20 Claims, 7 Drawing Figures

PORTABLE BLIND AND SHELTER

BACKGROUND OF THE INVENTION

The invention relates to a flexible blind to be used by hunters, photographers, and others for concealment from wild life and to provide protection from the elements under certain conditions.

Formerly the provision of a blind for concealment involved carrying bulky heavy camouflage material, cutting and piling branches or brush found in the field, or constructing permanent rigid blinds. The use of such means was time consuming and did not provide the mobility to move from one area to the other for the hunter, photographer or other.

A search of the prior art revealed that of the patents found the following were most pertinent:

U.S. Pat. No. 295,013, Hunter, Mar. 11, 1984, 160-134 XR

U.S. Pat. No. 1,618,065, Davis, Feb. 15, 1927, 135-005 R

U.S. Pat. No. 3,134,426, Cherubin, May 26, 1964, 160-133 XR

U.S. Pat. No. 3,190,300, Wear'n, June 22, 1965, 135-005

None of the patents appear to disclose or relate to the problem solved by this invention. They appear pertinent to tents, awnings, bullet proof shields and similar subject matter but do not relate to a light weight, flexible, portable blind which may be simple to erect and inexpensive to construct.

SUMMARY OF THE INVENTION

The objects of this inventions are to provide a blind that is light in weight, is foldable, is easy to erect, is easy to fold, is compact when folded, is easy to carry when folded, can be carried within a holster like container and which may have a hood detachably secured thereto for protection from the rain or snow and may be constructed from readily available inexpensive materials.

In accordance with the invention a blind comprising a substantially semi-circular screen formed of light weight flexible material having a central rigid mast member affixed thereto along the central radius, the mast having ends projecting beyond the lower diametral straight edge and the arcuate upper edge, the projection below the straight edge having a ground penetrating element affixed thereto and the projection above the upper arcuate edge may have a rubber tip affixed thereon.

Affixed to the member along radii spaced from the central radius are a number of rigid rib or rod members, an equal number disposed on each side of the central mast and the ones farthest removed from the central mast lying along the straight diametral edge of the flexible screen member. When carried the flexible screen member and the ribs are folded against the central mast and a flexible loop secured to the mast and secured around the member and ribs so that they are retained in the folded position and one terminal end of the loop is sufficiently large to be carried over the shoulder.

When a proper location is located the ribs and material are released by untying the looped member and the ground penetrating member is inserted into the earth, the flexible material automatically fans out to produce a screen for the user.

The holster like carrier may be used and if used the loop is attached to the carrier and need not be secured to the central mast.

In the event the blind is used in inclement weather a quarter hemisphere, a semi-conical or flat sheet of flexible material may be attached to the ribs, central mast or screen and whereby with the screen of the blind it provides a shelter.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 4:
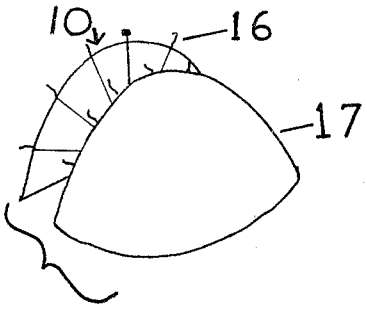
FIG. 4 is a perspective exploded view of the blind combined with a quarter spherical shaped clear plastic flexible hood.

Referring now to the drawing in detail, wherein like numerals indicate like elements in the several views. The blind of the present invention is generally identified as 10 and comprises a central mast member 1, ribs or rods 2 and a flexible sheet material screen element 3 which is substantially semi-circular and attached to the mast and ribs.

The central mast 1 is constructed from readily available materials such as bamboo, welding, aluminum or similar rigid material rods the length and diameter varying with the size of the flexible screen 3. If bamboo is used a short metal ground penetrating rod 4 is inserted into its hollow end and secured therein by glue, pins or other conventional means. To the upper end of the mast is secured a rubber tip 5. The tip maybe secured in a manner similar to that described for securing the ground penetrating rod.

The screen element 3 is substantially semi-circular in shape and is formed from cloth, plastic, semi-transparent netting or any other form of light weight, flexible material. A preferred material is camouflage netting which is used by the armed forces and frequently available in military surplus stores.

The mast 1 is secured to the screen 3 near or on the central vertical radius of the screen.

Rods or ribs 2 of light weight rigid material similar to that used for the mast are shorter and have substantially the same length as the radii of the screen 3 and lie on radii spaced from the central radius.

The mast 1 and ribs 2 are connected to the screen by means of a narrow strip of material 18 similar to that of the screen, forming with the screen material a passageway or sleeve into which the mast and ribs are received and secured by wire, staples or other means. As shown the strips 18 are attached to the screen 3 by stitching 6 however, the strips may be attached to the screen by laminating, adhesives, staples, tacks or other conventional means. The mast and ribs may be secured against movement in the sleeve by wire, staples or similar means.

Figure 1:
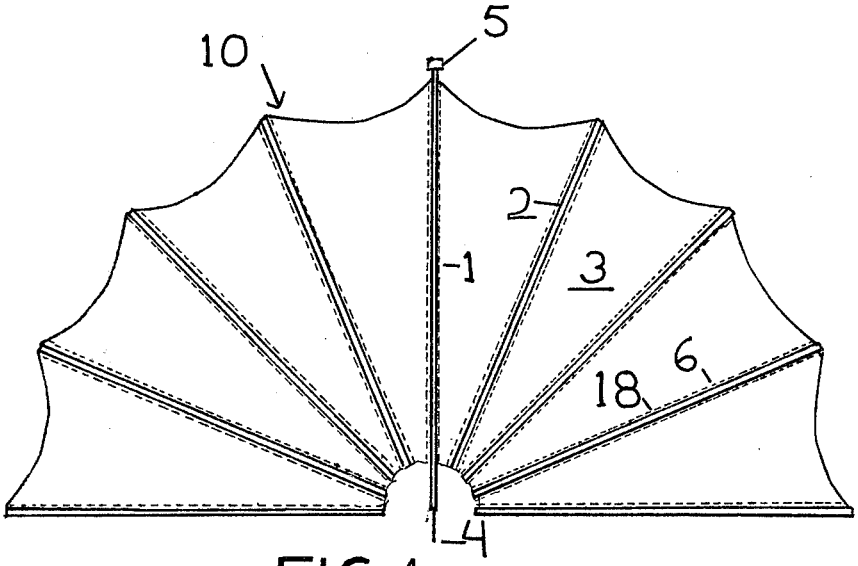
FIG. 1 is a view in elevation of the blind of the invention in an erected fanned out position.
Figure 2:
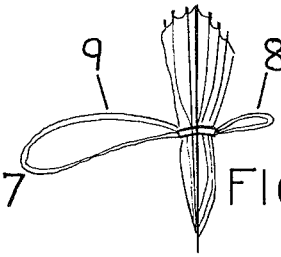
FIG. 2 is a view of the blind in a folded, furled position showing the carrier loop.

In use the blind is carried in a folded position such as that illustrated in FIG. 2. When it is desired to place the blind in a position of use the ground penetrating member 4 is inserted into the earth, the loop 7 is untied and the blind fans out to expanded position thereby providing a screen such as is illustrated in FIG. 1. In the position of FIG. 1 the hunter or other user is concealed from the view of the game and may assume a prone or sitting position.

Figure 3:
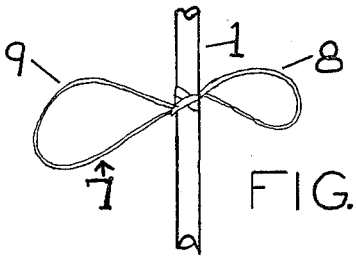
FIG. 3 is a detail view of the carrier loop attached to the central mast.

FIG. 3 illustrates a method of attaching the loop 7 to the mast 1 by simply tying it thereto leaving a short end 8 and a longer end 9 which when they are tied around the folded blind the loop 9 of the longer end is sufficiently large to fit over a man's shoulder to provide for carrying the folded blind, thereby leaving the hands free to carry game, gun and or any other equipment. In practice, with the screen formed of camouflage netting and the mast and ribs of bamboo, the blind weighs approximately 7 ounces.

Figure 7:
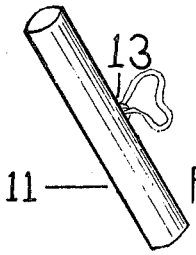
FIG. 7 is a perspective view of a holster like container with a carrying loop attached.

FIG. 7 illustrates a holster like receptacle 11 having an eye member 13 to which the loop 7 is attached. The receptacle may be or rigid or flexible light weight material and eliminates the need for attachment of the loop 7 to the mast 1 and offers protection for the folded blind.

Figure 5:
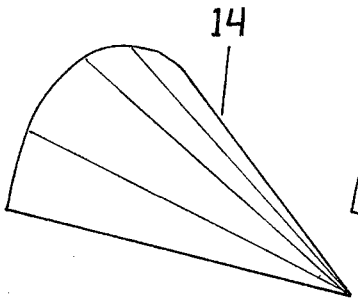
FIG. 5 is a similar view of the blind combined with a semi-conical shaped hood.
Figure 6:
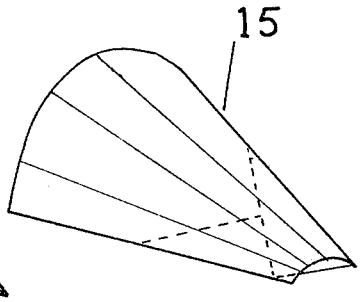
FIG. 6 is a similar view of the blind combined with a flat sheet of flexible plastic with the corners turned under to form a partial floor.

FIGS. 4, 5 and 6 illustrate hood members 17, 14 and 15 which may be secured to the arcuate edge of the screen 3 by means of buttons, straps, snaps or any conventional means, any light weight flexible material which is moisture impervious may be used although a light weight foldable clear plastic such as nylon, Mylar or Pliofilm is preferred. As an example, straps are illustrated at 16 in FIG. 4.

FIGS. 4 and 5 illustrate shaped plastic hoods.

In FIG. 4 the plastic hood 17 is shaped as a quarter sphere and may include a floor.

In FIG. 5 the hood 14 is similar to that illustrated in FIG. 4 but is of semi-conical shape. The hood 14 may also include a floor.

In FIG. 6 there is illustrated a simple rectangular sheet 15 of light weight foldable material having a width substantially the same as the arcuate dimension of the screen 3 and being detachably connected to the arcuate edge of the screen by any suitable conventional means. The edges of the rectangular member are folded inward so at least a partial floor is provided.

While specific embodiments of an easily transportable, flexible, foldable light weight blind which may be used with or without a shelter hood have been disclosed, it will be understood that various modifications within the spirit of the invention may occur to those skilled in the art. Therefore, it is intended that no limitation be placed on the invention except as defined by the scope of the appended claims.

I claim:

1. A structure for use as a blind or shelter to obscure or conceal the position of the user comprising a single supporting mast having a ground penetrating portion, a light weight, flexible, substantially planar semi-circular screen, said mast being secured thereto along a radius thereof and ribs or rod members secured to said screen portion along other radii thereof, said ground penetrating portion of said mast extending beyond a straight diametral edge of said screen, one end of each of said ribs or rod members terminating substantially adjacent to the end of the top of the ground penetrating portion and the others ends of said ribs or rod members terminating at the semi-circular edge portion at the circumference of the screen.

2. The structure of claim 1 in which the supporting mast and ribs are of a substantially light weight rigid materials.

3. The structure of claim 2 in which the rigid material is synthetic.

4. The structure of claim 3 in which the rigid material occurs in nature.

5. The structure of claim 2 in which the mast is of wood, the wood is bamboo having a hollow end portion and the ground penetrating member is a sharpened metallic rod secured in the hollow end portion.

6. The structure of claim 1 in which the screen member is of light weight, flexible, foldable material.

7. The structure of claim 1 in which the supporting mast is bamboo and the ground penetrating element is a sharpened metallic member secured in the hollow portion of the mast and the screen member is of camouflage netting, the ribs also being of bamboo.

8. The structure of claim 1 in which the supporting mast and ribs are secured to the screen by being received in a space defined by elongated narrow strips secured at their elongated edges to the screen along radii of said screen by a securing means and by the surface of the screen between the edges of said strip.

9. The structure of claim 1 wherein the supporting mast is secured to the screen on the central radius thereof.

10. The structure of claim 9 wherein the ribs are secured to the screen on radii spaced at the arcuate edge of the screen from the central radius, the same number of ribs being disposed on each side of the supporting mast and one of said ribs lying on the radii defining the diametral edge of the screen on each side of the supporting mast.

11. The structure of claim 1 in which a carrying means is secured to said supporting mast.

12. The structure of claim 11 in which the carrying means comprises a loop of rope like material which is knotted about the supporting mast with a long loop and short loop whereby when the blind is folded, or furled, the long loop and short loop can be secured together with the long loop being of sufficient size to receive the arm and shoulder of the user so that the furled blind may be carried on the shoulder of the user thereby leaving his hands free to carry equipment or game.

13. The blind structure of claim 1 combined in a furled or folded position with a holster like receptacle in which a substantial portion of the structure is received, the receptacle having on one side an eye like member through which a carrier of flexible rope like material is attached, said carrier comprising a loop of rope like material of sufficient size to receive the arm and shoulder of a user, thereby freeing the hands of the user for carrying game and equipment.

14. The blind structure of claim 1 combined in an expanded or use position with a hood, said hood being formed of light weight flexible, foldable material, means attaching the end portion of the hood to the arcuate edge of the screen material, said attachment means being located on elements of said blind structure.

15. The combination of claim 14 in which the hood is shaped as quarter sphere.

16. The combination of claim 15 in which the hood has a floor portion integral therewith.

17. The combination of claim 14 in which the hood is semi-conical in shape.

18. The combination of claim 17 in which the hood has a floor portion integral therewith.

19. The combination of claim 14 in which the hood is a rectangular sheet of flexible material, the sheet being attached to the screen at an edge of said sheet defining its width.

20. The combination of claim 19 in which the longitudinal edges and the edge remote from the edge attached to screen are folded inward to define at least a partial floor portion.

* * * * *